US005328048A

United States Patent [19]

Stein

[11] Patent Number: 5,328,048

[45] Date of Patent: Jul. 12, 1994

[54] TOTE BOX

[75] Inventor: Eric D. Stein, Tega Cay, S.C.

[73] Assignee: Otto Industries, Inc., Charlotte, N.C.

[21] Appl. No.: 14,663

[22] Filed: Feb. 8, 1993

[51] Int. Cl.[5] ..... B65D 43/14

[52] U.S. Cl. ..... 220/334; 220/651; 220/315

[58] Field of Search ..... 220/334, 651, 652, 653, 220/641, 315, 324, 326

[56] References Cited

U.S. PATENT DOCUMENTS

| | | | |
|---|---|---|---|
| Re. 32,966 | 6/1989 | Miller et al. | 206/328 |
| Re. 33,384 | 10/1990 | Miller et al. | 206/508 |
| D. 306,264 | 2/1990 | Malmanger | D9/432 |
| 4,325,492 | 4/1982 | Kurze | 220/335 |
| 4,375,265 | 3/1983 | van de Wetering et al. | 220/1.5 |
| 4,432,407 | 2/1984 | Swingley | 220/334 |
| 4,466,541 | 8/1984 | Tabler et al. | 206/506 |
| 4,470,518 | 9/1984 | Stein | 220/346 |
| 4,572,368 | 2/1986 | Miller et al. | 206/328 |
| 4,643,310 | 2/1987 | Deaton et al. | 206/506 |
| 4,688,675 | 8/1987 | Miller et al. | 206/508 |
| 4,765,480 | 8/1988 | Malmanger | 206/506 |
| 4,804,082 | 2/1989 | Stein | 206/1.5 |
| 4,809,851 | 3/1989 | Oestreich, Jr. et al. | 206/599 |
| 4,832,200 | 5/1989 | Deaton et al. | 206/508 |
| 4,890.740 | 1/1990 | Tabler | 206/509 |
| 4,974,737 | 12/1990 | Miller | 220/4 A |
| 5,080,250 | 1/1992 | Dickinson et al. | 220/335 |
| 5,094,356 | 3/1992 | Miller | 220/7 |

*Primary Examiner*—Joseph Man-Fu Moy
*Attorney, Agent, or Firm*—Reising, Ethington, Barnard, Perry & Milton

[57] ABSTRACT

A tote box style container (10) including a base (12) defining the bottom of the container (10), a pair of sidewalls (14) and a pair of end walls (16) extending upwardly from the base (12) to define an interior (18) of the container (10). A pair of lids (20) are hingedly connected to the upper portion of the sidewalls (14) of the container (10) along one edge of each lid (20) and moveable between a closed position barring access to the interior (18) of the container (10) and an open position where access to the interior (18) of the container (10) is not barred. At least one of the sidewalls (14) includes offset portions (22) extending along the vertical expanse of the interior of the sidewall (14) and in spaced parallel relation with respect to each other; At least one of the offset portions (22) terminates at its upper end so as to from a shelf (24) on the interior of the sidewall. The lids (20) include a force distributing rib (40) extending in spaced parallel relation to the hinged edge of the lids (20) along a portion of the length of the lids (20) and downwardly from the underside of the lids (20) when the lids (20) are in the closed position such that the rib (40) is in adjacent abutting relation to the interior of the sidewall (14) above the shelf (24) and such that the distal end (42) of the rib (40) is in contact with the shelf (24) to distribute loads placed on the container (10) through the sidewalls (14) to the base (12) of the container (10).

7 Claims, 5 Drawing Sheets

12
14
16
18
19
20
22
24
25
26
30
32
34
36
38
40
44
46
48
50
52
53
54
58
60
62
64
66
68
70
72
74

TOTE BOX

BACKGROUND OF THE INVENTION

1. Technical Field

The subject invention relates to tote box style containers of the type used to inventory and distribute loose or broken case items and soft goods. More specifically, the invention relates to tote boxes which may be stacked one on top of another during shipping or inventorying of goods and which may be nested when empty.

2. Description Of The Prior Art

The subject invention is directed toward a tote box used primarily to inventory and distribute broken case items and soft goods. At the manufacturing and distributor level, many goods are inventoried in cases or larger quantities. A customer or retail outlet for the manufacturer or distributor may require various goods but in quantities less than the smallest number inventoried in bulk by the manufacturer or distributor. The manufacturer or distributor may have many customers or retail outlets in this position.

In order to streamline the inventorying and shipping process, distributors and manufacturers alike may employ containers commonly referred to as tote boxes. Tote box type containers may be shipped each containing a certain quantity of a product. At each customer or retail outlet, the desired quantity of goods may be selected from any given container and left with the customer or retail outlet.

Containers of this type include a base, a pair of sidewalls and a pair of end walls extending upwardly from the base to define an interior of the container. Tote box containers also include a pair of lids hingedly connected to the upper portion of each of the sidewalls and which are moveable from a closed position precluding access to the interior of the container and an open position where the lids hang down in a substantially vertical orientation adjacent the sidewalls on the exterior of the container.

The tote boxes are generally stackable, one on another, when the lids are closed and nestable when open. As such, a tractor trailer may be shipped full of products in containers, stacked one upon another. When the containers are empty, they may be nested taking up much less of the capacity of the tractor trailer. The remaining shipping space may be used to haul manufactured goods back to a distribution point.

Examples of such containers can be found in U.S. Pat. No. RE 33,384 reissued to Miller et al. on Oct. 16, 1990 and directed toward a Nesting Box With Reduced Lid Flare; U.S. Pat No. RE 32,966 reissued to Miller et al. on Jun. 27, 1989 and directed toward a Tote Box; and U.S. Pat. No. 4,620,644 issued to Miller on Nov. 4, 1986 and directed toward a Tote Box With Lid Container.

Because they are reusable, stackable and nestable, tote box containers are fast replacing corrugated cardboard type boxes as the most cost effective shipping container of many goods. However, as the popularity of these types of containers increase, they are employed to inventory and ship an ever growing list of products. Tote box containers are thus subjected to ever increasing loads during shipping and inventorying. Tote box users are concerned about longevity of the containers as a measure of their cost effectiveness. The longer they last, the more money saved by the user. Many prior art containers of this type were not designed to function under these loads. This has resulted in container failures, especially at the lid and lid-hinge interface.

SUMMARY OF THE INVENTION AND ADVANTAGES

The subject invention overcomes the problems in the prior art in a container including a base defining the bottom of the container, a pair of sidewalls and a pair of end walls extending upwardly from the base to define an interior of the container. A pair of lids are hingedly connected to the upper portion of each of the sidewalls along one edge of the lid and are moveable between a closed position barring access to the interior of the container and an open position where access to the interior of the container is not barred. The sidewalls include offset portions extending along the vertical expanse of the interior of the sidewalls and in spaced parallel relation with respect to each other. The offset portions terminate at their upper ends so as to form shelves on the interior of the sidewalls. The lids include a force distributing rib extending in spaced parallel relation to the hinged edge of the lid along substantially the entire length of the edge of the lid and downwardly from the underside of the lid when the lid is in the closed position such that the rib is in adjacent abutting relation to the interior of the sidewall above the shelf and such that the distal end of the rib is in contact with the shelf to distribute loads placed on the container through the sidewall to the base of the container.

In addition to the force distributing rib, each of the lids include a downwardly extending edge cover flange extending along opposite edges of the lids perpendicular to the hinged edge of the lid and parallel to the end walls of the container. Each lid has edge reinforcing ribs disposed on the underside thereof facing the interior of the container when the lids are in their closed position. The edge reinforcing ribs extend parallel to the downwardly extending cover flange. A brace member extends between the edge reinforcing rib on the underside of the lid and the cover flange. The end walls include notches disposed on the uppermost portion of the end walls. The brace member is received by the notches to resist movement of the lid under load in a direction perpendicular to the hinged edge of the lid and to distribute loads placed on the container through the end walls to the base of the container.

The tote box of the subject invention includes all of the features of a light weight, tote box made from high density polyethylene but which is specifically designed to dissipate loads away from the weaker lids down the side and end walls of the container to the base. In this way, the tote box container of the subject invention may be subjected to larger loads than conventional prior art containers.

DESCRIPTION OF THE PREFERRED EMBODIMENT

Figure 1:
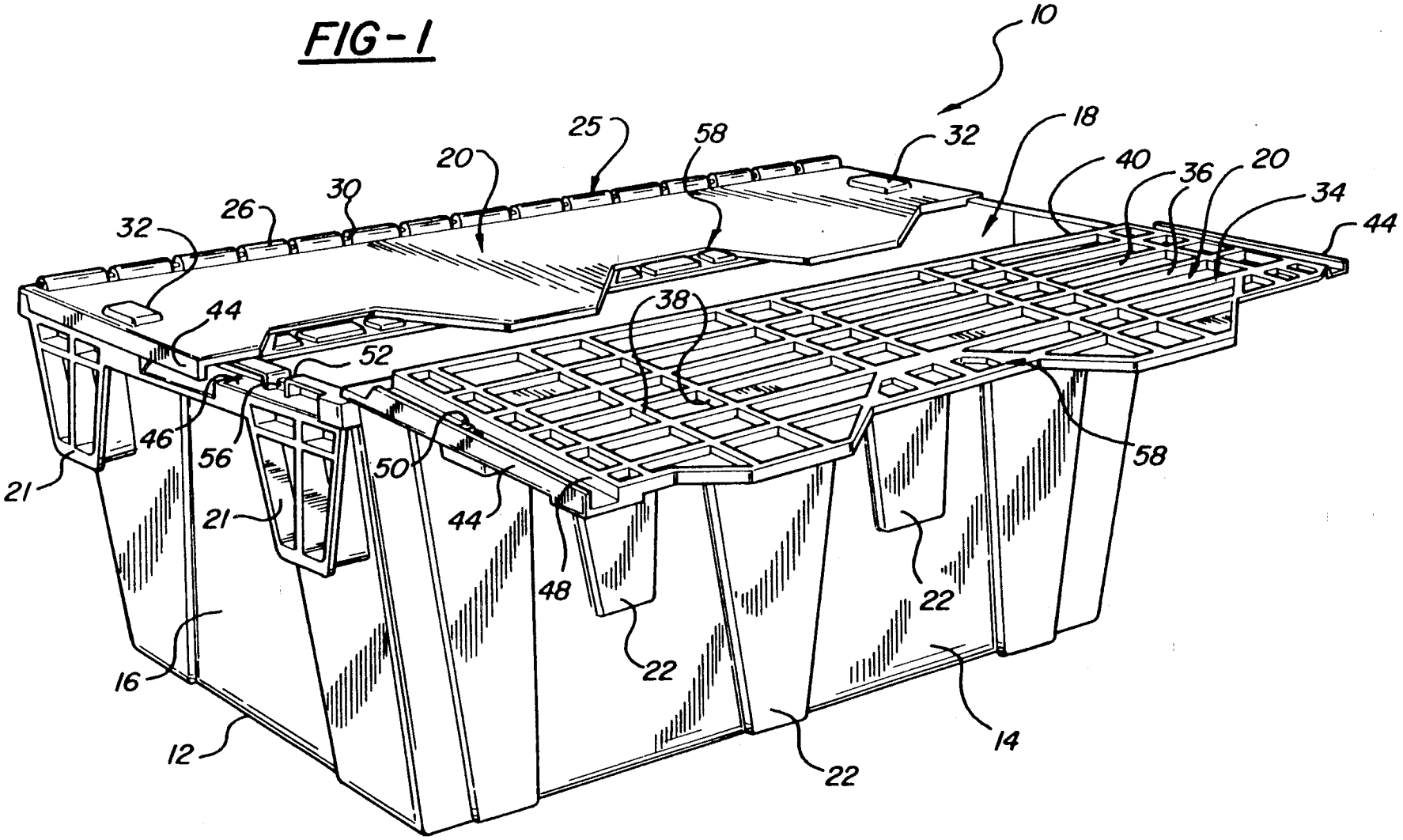
FIG. 1 is a perspective view of the tote box container of the subject invention.

A tote box style container of the kind used to inventory and ship broken case items and soft goods is generally shown at 10 in FIGS. 1–2 and 3–4. The container includes a base 12 defining the bottom of the container 10, a pair of side walls 14 and a pair of end walls 16 formed integrally with the base 12 and extending upwardly from the base 12 to define an interior 18 of the container 10.

Figure 3:
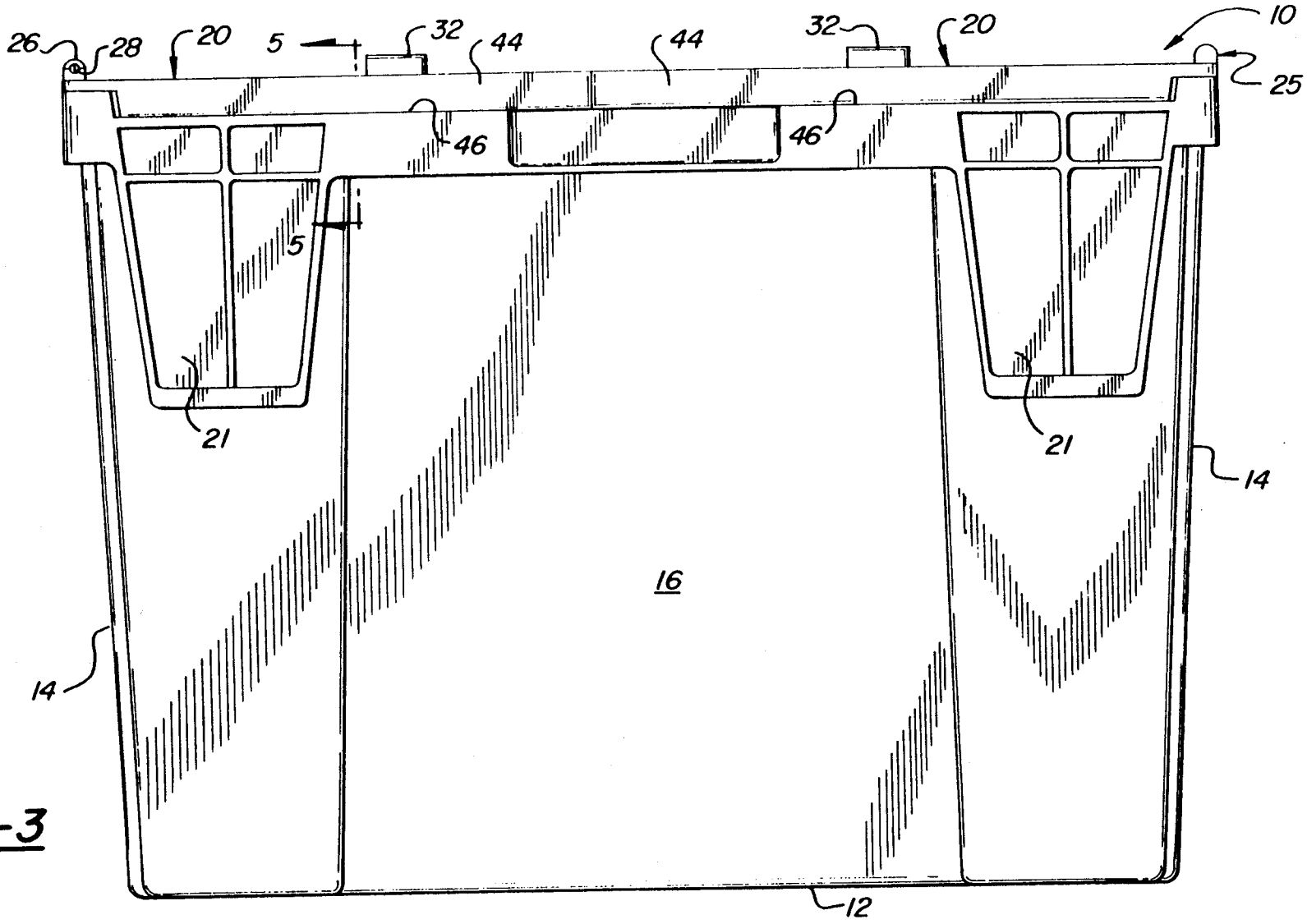
FIG. 3 is a side view of the end wall of the container of the subject invention.
Figure 4:
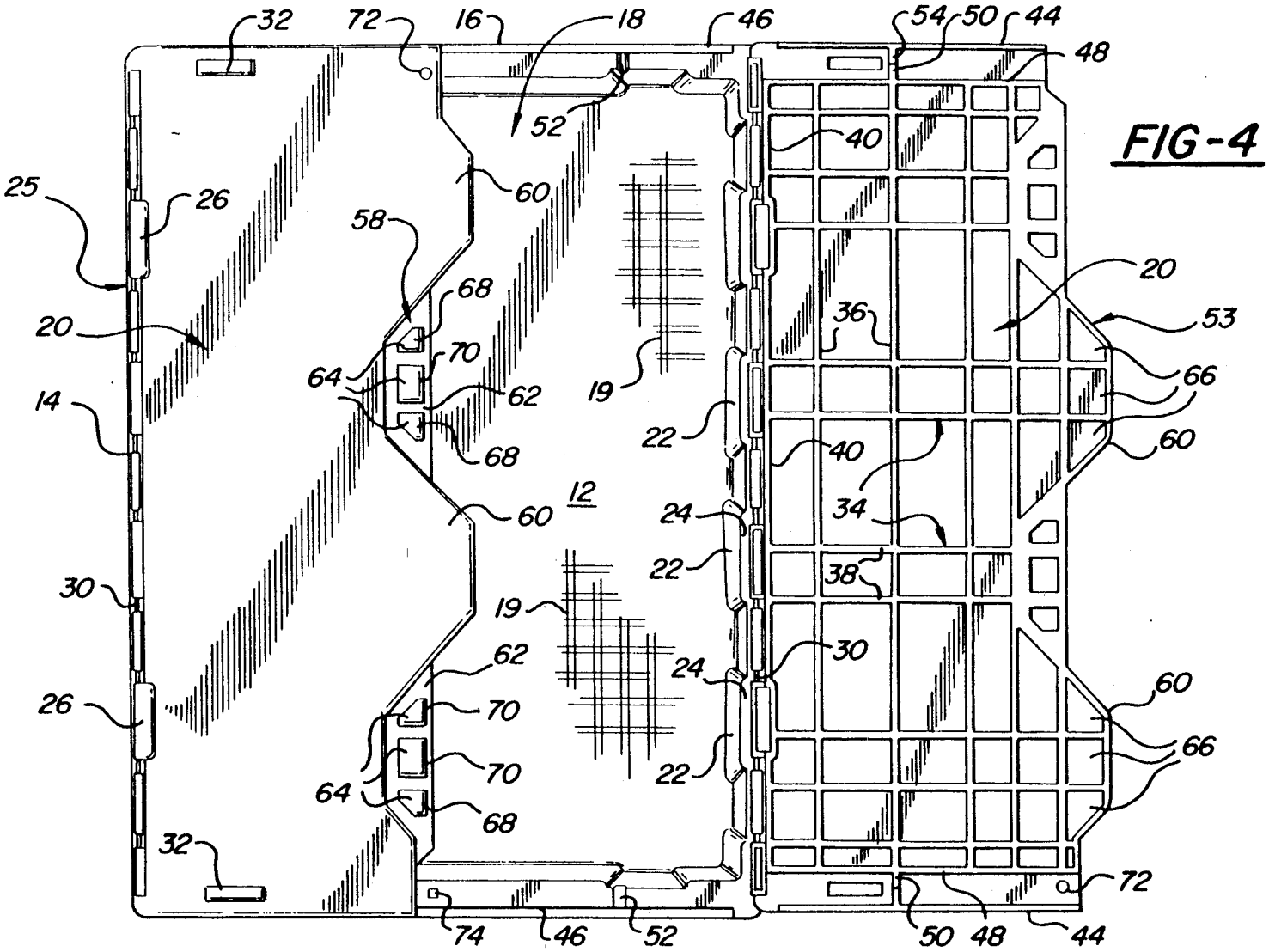
FIG. 4 is a top elevational view of the container of the subject invention.

The tote box 10 may include a single lid or a pair of lids, generally indicated at 20, each hingedly connected to the upper portion of a respective side wall 14 along one edge of each lid 20. As shown in FIG. 3 in a side view of an end wall 16, each of the lids 20 has a closed position barring access to the interior 18 of the box 10 when both of the lids 20 are in their closed position. The lids 20 are moveable between the closed position and an open position where access to the interior 18 of the box 10 is not barred. This may occur when only one lid 20 is moved to the open position, as shown in FIGS. 1 and 4. It should be noted, however, that the lids 20 will hang down in a substantially vertical disposition 270° from the closed position and not as depicted in FIGS. 1 and 4. The open lids 20 in FIGS. 1 and 4 are disposed rotated 180° from their closed position to illustrate other features of the container 10 which will be discussed in further detail below.

In the preferred embodiment, the base 12, side and end walls 14, 16, respectively are integrally molded of high density polyethylene plastic. The base 12 may include a planer interior sheet or may be in the form of a grid 19 as indicated in FIG. 4. The side and end walls 14,16 are both tapered such that the container 10 will nest one within the other when empty. The end walls 16 each include a pair of handles 21 which also serve to limit the nesting of the containers. When the lids 20 are in their closed position, the container 10 may also be stacked one on top of the other.

The tote box 10 of the subject invention may be manufactured in a variety of sizes with typical dimensions including 20×12×7; 21×15×9; 27×17×12; and 28×20×15. The tote box 10 of the subject invention is designed to inventory and ship a wide variety of products from pharmaceuticals, health and beauty aids and soft goods as well as heavier items such as hardware and automotive parts. When heavier items are shipped or stored in tote boxes and stacked one on top of the other, each container can be subjected to large loads which heretofore were not contemplated by designers of prior art containers. As such, many prior art containers are unable to withstand such loads and will fail, typically at the lid and/or lid-hinge interface of the container. The subject invention, on the other hand, is designed to withstand greater loads in a lightweight, cost effective container as will be discussed in greater detail below.

Each of the sidewalls 14 includes a plurality of offset portions 22 extending along the vertical expanse of the sidewall 14 from the upper portion of the sidewalls 14 downwardly on both the interior and exterior of the sidewalls 14. Some offset portions 22 extend substantially the entire vertical expanse of the sidewalls 14 and others a shorter distance. The offset portions 22 are disposed in spaced substantially parallel relation with respect to each other. This alternating structure of the offset portions 22 adds strength to the sidewalls 14. As can be best seen with reference to FIGS. 2*a*, 2*b* and 4, each of the offset portions 22 terminate at their upper ends to form shelves 24 on the interior of the sidewalls 14.

The tote box 10 also includes a hinge means, generally indicated at 25 in the figures, interconnecting the lids 20 to the sidewalls 14. The hinge means 25 define a pair of longitudinal axes about which each lid 20 is rotated between its open and closed position. The hinge means 25 includes a lid hinge body 26 disposed along the edge of each lid 20 adjacent the uppermost portion of the respective sidewall 14. The hinge body 26 includes an aperture 28 for receiving a hinge rod 30 which defines the longitudinal axis of each lid hinge body 26.

Referring now to FIGS. 1 and 4, the exterior surfaces of the lids 20 are substantially planer sheets and which include stacking lugs 32 located near the edges of the lids 20 parallel to the end walls 16. The stacking lugs 32 along with the hinge bodies 26 serve to orientate and position boxes and inhibit lateral movement of the boxes as they are stacked one on top of the other.

The lids 20 also include a plurality of strengthening ribs, generally indicated at 34, located on the interior surface of the lids 20. The ribs 34 include longitudinally extending ribs 36 which are substantially parallel to the hinge rod 30 defining the longitudinal axis of the hinge means 24 of each lid 20 and transverse ribs 38 which are perpendicular to the longitudinal ribs 36. Both the longitudinal 36 and transverse 38 ribs are concentrated in areas which are subjected to higher loads or which are traditionally weaker areas of the lids.

Figure 2:
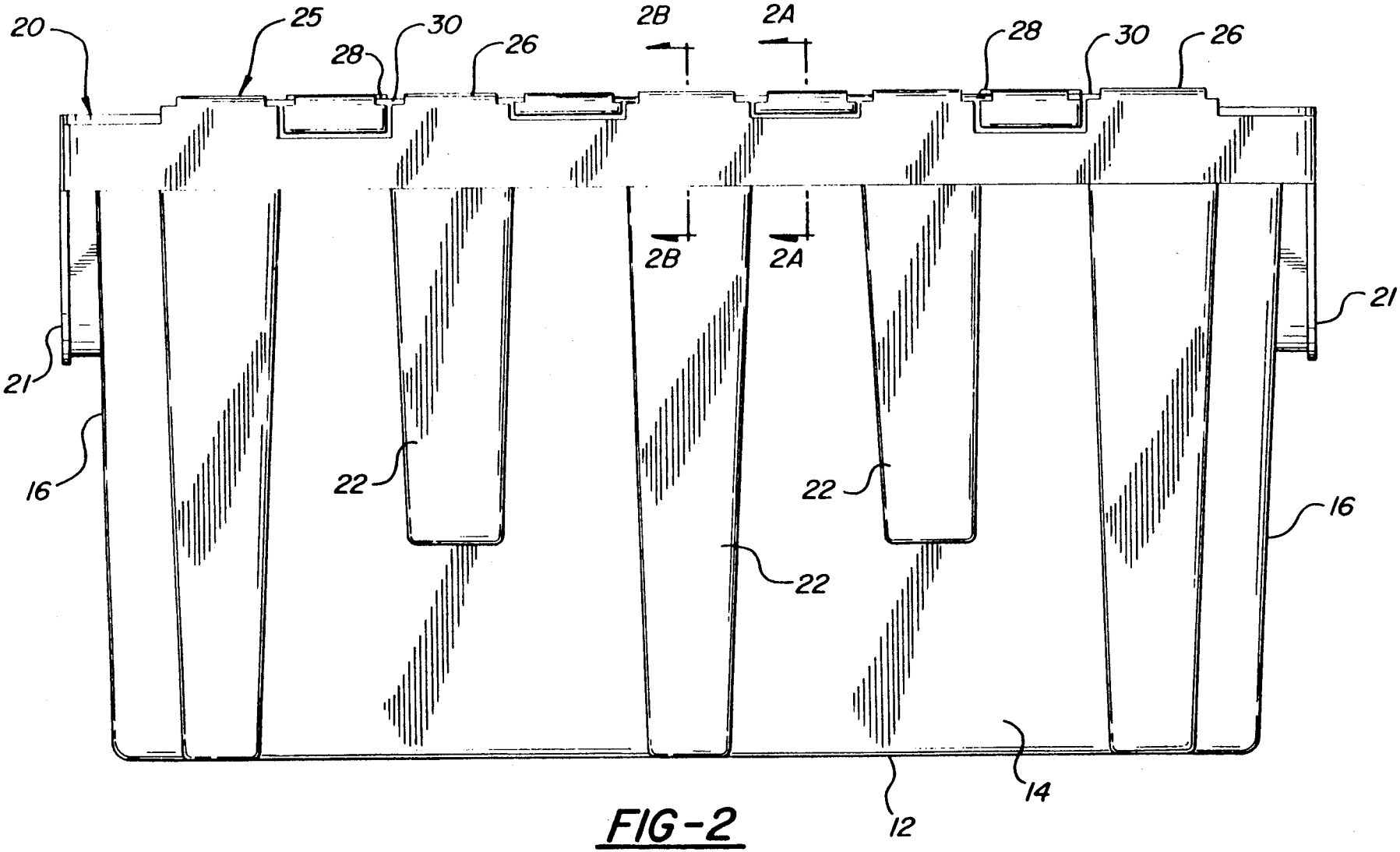
FIG. 2 is a side view of the sidewall of the container of the subject invention.
Figure 2B:
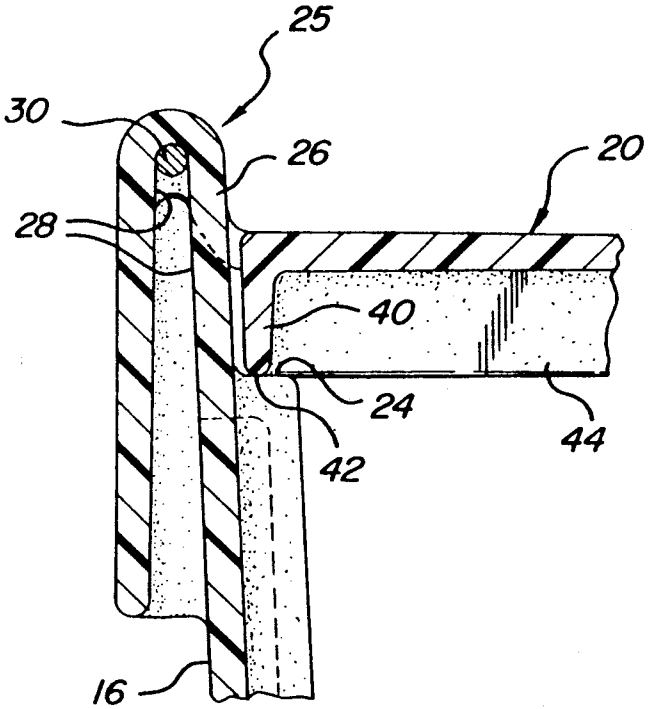
FIG. 2*b* is a cross-sectional view taken substantially along lines 2*b*—2*b* of FIG. 2.
Figure 2A:
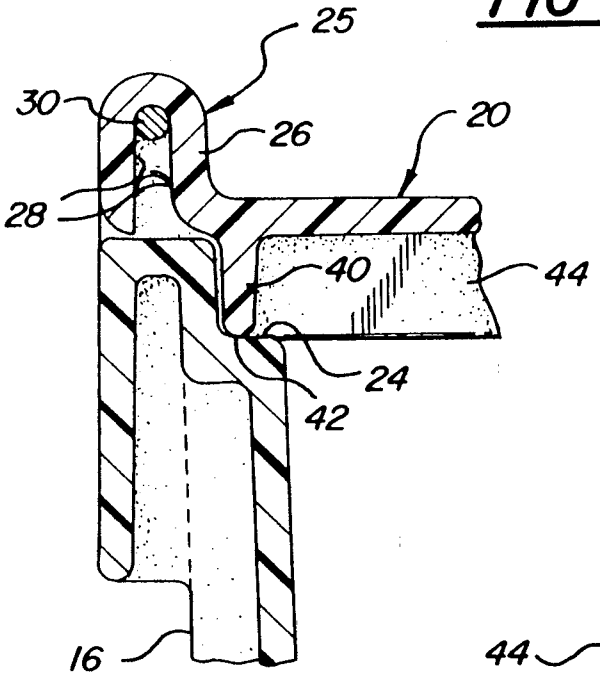
FIG. 2*a* is a cross-sectional view taken substantially along lines 2*a*—2*a* of FIG. 2.

Referring to FIGS. 1, 2*a*, 2*b* and 4, the lids 20 also include a force distributing rib 40 extending in spaced parallel relation to the hinged edge of the lids 20 along a portion of the length of the lids 20 and downwardly from the underside or interior of the lids 20 when the lids 20 are in their closed position. More specifically, the rib 40 extends from the underside of each of the lids 20 along substantially the entire length of the edge of the lid 20 such that the rib 40 is in adjacent abutting relation to the interior of the sidewall 14 above the shelves 24 and such that the distal end 42 of the rib 40 is in contact with each of the shelves 24 to distribute loads placed on the container 10 through the sidewall 14 to the base 12 of the container 10. As can be seen in FIGS. 2*a* and 2*b*, the force distributing rib 40 defines a plane disposed in spaced parallel relation to the longitudinal axis defined by the hinge rod 30 of the hinge means 24 and the lids 20 define a plane disposed perpendicular to the plane defined by the rib 40.

In this way, the boxes 10 are able to sustain greater loads because the forces placed on each box 10 when stacked are channelled down through the sidewalls 14 of the boxes 10 to the base 12 and away from the lids 20.

Each of the lids 20 includes a downwardly extending edge cover flange 44 extending along opposite edges of the lids 20 perpendicular to the rod 30 at the hinged edge of the lids 20 and parallel to the end walls 16 of the box 10. The cover flange 44 rests on a ridge 46 formed near the uppermost portion of the end wall 16 to support the lid 20 along the end wall 16 and also to transfer loads down the end walls 16 to the base 12.

Each lid 20 has a pair of special edge reinforcing ribs 48 disposed on the underside thereof facing the interior 18 of the container when the lids 20 are in their closed position. The edge reinforcing ribs 48 extend parallel to the downwardly extending cover flanges 44. A brace member 50 extends between the edge reinforcing ribs 48 on the underside of the lids 20 and the cover flanges 44. The end walls 16 include notches 52 disposed on the uppermost portion of the end wall 16. The brace member 50 is received by the notches 52 to resist movement of the lids 20 under load in a direction perpendicular to the rod 30 at the hinged edge of the lid 20 and to distribute loads placed on the container 10 through the end walls 16 to base 12 of the container 10.

Figure 5:
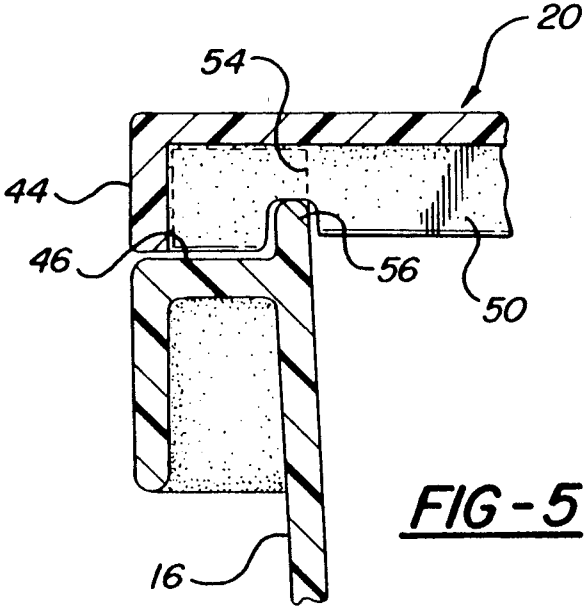
FIG. 5 is a cross-sectional view taken substantially along lines 5—5 of FIG. 3.

As best shown in FIG. 5, the brace member 50 includes a step portion 54. Each of the notches 52 include an upstanding rib 56. The stepped portions 54 of the brace member 50 are disposed in adjacent butting relation to the upstanding notch ribs 56 when the lids 20 are in their closed position. In this way, the movement of the lid 20 under load may be limited in a direction parallel to the rod 30 at the hinged edge of the lid 20. In addition, the transverse loads placed on the lids 20 may be transferred through the brace members 50 and notches 52 to the end walls 16 and ultimately the base 12 of the container 10.

The tote box 10 of the subject invention is further strengthened through locking means, generally indicated at 58, in FIGS. 1 and 4 for interlocking the opposed lids 20 together when they are in their closed position. The locking means 58 includes, for each of the opposed lids 20, a plurality of fingerlike members 60 and a plurality of recessed receiving portions 62 alternatingly disposed along an edge of the lids 20 opposite the rod 30 at the hinged edge of the container 10. Each of the fingerlike members 60 is disposed so as to be received in a recessed receiving portion 62 of the opposed lid 20 such that the opposed lids 20 present a single planer surface when they are in their closed position as shown for example in FIG. 3.

Each of the recessed receiving portions 62 includes at least one tab 64 projecting upwardly from the receiving portion 62. Each of the fingerlike members 60 includes sockets 66 corresponding to the tab 64 and adapted to receive the tabs 64 when the lids 20 are in their closed position. Each of the tabs 64 include an uppermost platform surface 68 and four sides extending between the platform surface 68 and the recessed receiving portion 62. One of the sides 70 extends in a direction substantially parallel to the rod 30 at the hinged edge of the lids 20. The parallel side 70 is tapered at an angle of at least 25° so as to guide the tab 64 into the socket 66 when the lids 20 are moved to their respective closed positions. In the Tote Box of the subject invention, the side 70 is tapered at an angle of 30°.

Each lid 20 also includes an aperture 72 which corresponds to a hole 74 in the top of the end walls 16. The aperture 72 and hole 74 are adapted to receive a plastic tie or other securing means so that the lids 20 may be locked in the closed position and thus prevent pilfering of the contents of the boxes 10.

Altogether, the force distributing flange 40 of the lids 20, the shelves 24 of the sidewalls 14, the edge cover flanges 44 of the lids 20, the ridge 46 of the end walls 16, the special edge reinforcing ribs 48 and the brace member 50 of the lids 20, the notch 52 on the end walls 16 as well as the interlocking fingers and receiving portions all coact to provide a tote box 10 which is able to withstand much higher loads and inventory and ship heavier products than tote boxes of the prior art. These features also increase the useful life of the tote box 10 of the subject invention making it more cost effective than corrugated cardboard and the prior art containers.

The invention has been described in an illustrative manner, and it is to be understood that the terminology which has been used is intended to be in the nature of words of description rather than of limitation. Obviously, many modifications and variations of the present invention in light of the above teachings may be made. It is, therefore, to be understood that within the scope of the impended claims wherein reference numerals are merely for convenience and are not to be in any way limiting, the invention may be practiced otherwise than as specifically described.

What is claimed is:

1. A container (10) comprising;

a base (12) defining the bottom of the container (10), a pair of sidewalls (14) and a pair of end walls (16) extending upwardly from said base (12) to define an interior (18) of said container (10);

a lid (20) hingedly connected to the upper portion of a sidewall (14) of said container (10) along one edge of said lid (20) and moveable between a closed position barring access to the interior (18) of said container (10) and an open position where access to the interior (18) of the container (10) is not barred;

at least one of said sidewalls (14) including offset portions (22) extending along the vertical expanse of the interior of said sidewall (14) and in spaced parallel relation with respect to each other, at least one of said offset portions (22) terminating at its upper end so as to form a shelf (24) on the interior of said sidewall (14);

said lid (20) including a force distributing rib (40) extending in spaced parallel relation to the hinged edge of said lid (20) along a portion of the length of said lid (20) and downwardly from the underside of said lid (20) when said lid (20) is in the closed position such that said rib (40) is in adjacent abutting relation to the interior of said sidewall (14) above said shelf (24) and such that the distal end (42) of said rib (40) is in contact with said shelf (24) to distribute loads placed on said container (10) through said sidewall ( 14 ) to the base ( 12 ) of said container (10) .

2. A container (10) as set forth in claim 1 further characterized by said container (10) including a hinge means (25) interconnecting said lid (20) to at least one sidewall (14), said hinge means (25) defining a longitudinal axis about which said lid (20) is rotated between said open and closed positions, said force distributing rib (40) defining a plane disposed in spaced parallel relation to said longitudinal axis of said hinge means (25) to distribute loads placed on said container (10) through said sidewall (14) to the base (12) of said container (10).

3. A container (10) as set forth in claim 2 further characterized by including a pair of lids (20) hingedly connected to the upper portion of each of said sidewalls (14) along one edge of each of said lids (20), each lid (20) moveable between a closed position barring access to the interior (18) of said container (10) when both lids (20) are in said closed position and an open position where access to the interior (18) of said container (10) is not barred when at least one of said lids (20) is in said open position, each of said sidewalls (14) including offset portions (22), each of said offset portions (22) terminating at their upper ends to form shelves (24) on the interior of said sidewalls (14), said force distributing rib (40) extending from the underside of each of said lids (20) along substantially the entire length of the edge of said lid (20) such that the distal end (42) of said rib (40)

is in contact with each of said shelves (24) to distribute loads placed on said container (10) through said sidewall (14) to the base (12) of the container (10).

4. A container (10) as set forth in claim 3 further characterized by said hinge means (25) including a lid hinge body (26) disposed along the edge of said lids (20) adjacent the uppermost portion of said sidewall (14) and including an aperture (28) for receiving a hinge rod (30) defining said longitudinal axis of said hinge means (25), said lids (20) defining a plane disposed perpendicular to said plane defined by said rib (42).

5. A container (10) comprising;

a base (12) defining the bottom of the container (10), a pair of sidewalls (14) and a pair of end walls (16) extending upwardly from said base (12) to define an interior (18) of said container (10);

a pair of lids (20) hingedly connected to the upper portion of respective sidewalls (14) of said container (10) along one edge of each of said lids (20) and in opposed relation with respect to one another, each lid (20) being moveable between a closed position barring access to said interior (18) of said container (10) when both lids (20) are in said closed position and an open position where access to said interior (18) of said container (10) is not barred when one of said lids (20) is in said open position;

each of said lids (20) including a downwardly extending edge cover flange (44) extending along opposite edges of said lids (20) perpendicular to the hinged edge of said lid (20) and parallel to the end walls (16) of said container (10);

each lid (20) having edge reinforcing ribs (48) disposed on the underside thereof facing the interior (18) of said container (10) when said lids (20) are in their closed position, said edge reinforcing ribs (48) extending parallel to said downwardly extending cover flange (44);

a brace member (50) extending between said edge reinforcing ribs (48) on the underside of said lid (20) and said cover flange (44), said end walls (16) including notches (52) disposed on the uppermost portion of said end walls (16), said brace member (50) received by said notches (52) to resist movement of said lid (20) under load in a direction perpendicular to the hinged edge of said lid (20) and to distribute loads placed on said container (10) through said end walls (16) to the base (12) of said container (10).

6. A container (10) as set forth in claim 5 further characterized by said brace member (50) including a stepped portion (54), each of said notches (52) including an upstanding rib (56), said stepped portions (54) of said brace member (50) disposed in adjacent a butting relation to said upstanding notch ribs (56) to limit the movement of said lid (20) under load in a direction parallel to said hinged edge of said lid (20) and to distribute loads placed on said container (10) through said end wall (16) to said base (12) of said container (10).

7. A container (10) comprising;

a base (12) defining the bottom of the container (10), a pair of sidewalls (14) and a pair of end walls (16) extending upwardly from said base (12) to define an interior (18) of said container (10);

a pair of lids (20) each hingedly connected to the upper portion of a respective sidewall (14) of said container (10) along one edge of each of said lids (20) and in opposed relation with respect to one another, each lid (20) being moveable between a closed position barring access to the interior (18) of said container (10) when both of said lids (20) is in said closed position and an open position when access to the interior (18) of said container (10) is not barred when one of said lids (20) is in said open position;

locking means (58) for interlocking said opposed lids (20) together, said locking means (58) including for each of said opposed lids (20) a plurality of fingerlike members (60) and plurality of recessed receiving portions (62) alternatingly disposed along an edge of said lids (20) opposite said hinged edge, each fingerlike member (60) disposed so as to be received in a receiving portion (62) of said opposed lid (20);

each of said recessed receiving portions (62) including at least one tab (64) projecting upwardly from said receiving portion (62), each of said fingerlike members (60) including at least one socket (66) corresponding to said tab (64) and adapted to receive said tab (64) when said lids (20) are in their closed position, tab (64) including an uppermost platform surface (68) and four sides extending between said platform surface (68) and said receiving portion (62) with one of said sides (70) extending in a direction substantially parallel to the hinged edge of said lids (20), said parallel side (70) being tapered at an angle of at least 25° so as to guide said tab (64) into said socket (66) when said lids (20) are moved to their respective closed positions.

* * * * *